United States Patent [19]

Zwadlo et al.

[11] Patent Number: 5,061,583

[45] **Date of Patent: * Oct. 29, 1991**

[54] COLOR ELECTROPHOTOGRAPHY FOR HIGH QUALITY HALF-TONE IMAGES

[75] Inventors: Gregory L. Zwadlo; Kevin M. Kidnie; Mohamed A. Elmasry, all of St. Paul, Minn.

[73] Assignee: Minnesota Mining and Manufacturing Company, St. Paul, Minn.

[ * ] Notice: The portion of the term of this patent subsequent to Aug. 7, 2007 has been disclaimed.

[21] Appl. No.: 434,897

[22] Filed: Jan. 19, 1990

[51] Int. Cl.[5] ..... G03G 13/01; G03G 13/10

[52] U.S. Cl. ..... 430/45; 430/103; 430/114; 430/119

[58] Field of Search ..... 430/31, 45, 119, 103

[56] References Cited

U.S. PATENT DOCUMENTS

| | | | |
|---|---|---|---|
| 3,753,760 | 8/1973 | Kosel . | |
| 3,900,412 | 8/1975 | Kosel . | |
| 4,081,391 | 3/1978 | Tsubuko et al. . | |
| 4,155,862 | 5/1979 | Mohn et al. . | |
| 4,264,699 | 1/1981 | Tsubuko et al. | 430/112 |
| 4,275,136 | 6/1981 | Murasawa et al. | 430/117 |
| 4,480,022 | 10/1984 | Alexandrovich et al. | 430/119 |
| 4,525,446 | 6/1985 | Uytterhoeven et al. | 430/117 |
| 4,547,449 | 10/1985 | Alexandrovich et al. | 430/115 |
| 4,564,574 | 1/1986 | Uytterhoeven et al. | 430/115 |
| 4,606,989 | 9/1986 | Uytterhoeven et al. | 430/106 |
| 4,946,753 | 8/1990 | Elmasry et al. | 430/45 |

*Primary Examiner*—Roland Martin

*Attorney, Agent, or Firm*—Gary L. Griswold; Walter N. Kirn; Mark A. Litman

[57] ABSTRACT

There is disclosed here a class of liquid toner dispersions for developing electrophotographic images which give very high contrast half-tone dots with low contrast scanning light beams such as gaussian laser beams. The advantage of these toners is enhanced by the use of high electric field electrophoretic development conditions with high replenishment rate under which conditions rapid development to high image densities is obtained. This class of toners has toner particles of high mobility, low particle concentration in the dispersion, and a low fraction of its conductivity in the liquid milieu.

11 Claims, 1 Drawing Sheet

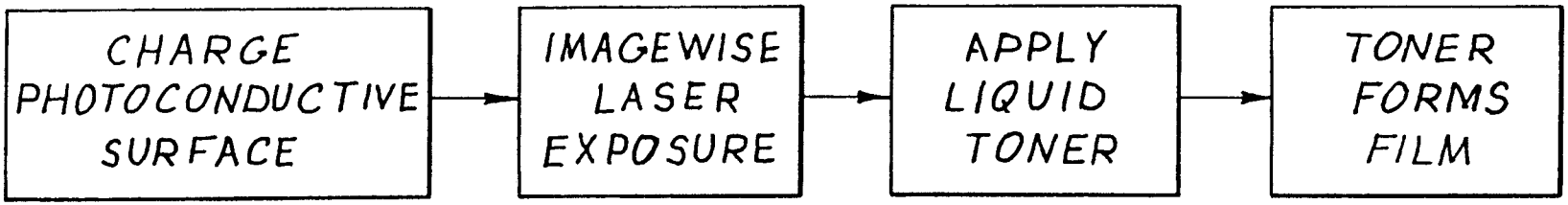
CHARGE PHOTOCONDUCTIVE SURFACE
IMAGEWISE LASER EXPOSURE
APPLY LIQUID TONER
TONER FORMS FILM

COLOR ELECTROPHOTOGRAPHY FOR HIGH QUALITY HALF-TONE IMAGES

BACKGROUND TO THE INVENTION

1. Field of Invention

The invention relates to processes for using laser-scan addressed electrophotographic systems to make and assemble a number of color half-tone separation images to give a full color reproduction. The invention is particularly related to methods of color proofing. It also has application for the production of single color images on transparent substrates.

2. Background of the Art

Full color reproductions by electrophotography were disclosed by C. F. Carlson in early patents (e.g. U.S. Pat. No. 2,297,691) but no detailed mechanisms were described and the toners disclosed were dry powders. U.S. Pat. No. 2,899,335 and U.S. Pat. No. 2,907,674 pointed out that dry toners had many limitations as far as image quality is concerned especially when used for superimposed color images. They recommended the use of liquid toners for this purpose. These toners comprised a carrier liquid which were of high resistivity e.g. $10^9$ ohm-cm or more, having colorant particles dipersed in the liquid, and preferably including an additive intended to impart the charge carried by the colorant particles. U.S. Pat. No. 3,337,340 disclosed that one toner deposited first may be sufficiently conductive to interfere with a succeeding charging step; it claimed the use of insulative resins (resistivity greater than $10^{10}$ ohm-cm) of low dielectric constant (less than 3.5) covering each colorant particle. U.S. Pat. No. 3,135,695 disclosed toner particles stably dispersed in an insulating aliphatic liquid, the toner particles comprising a charged colorant core encapsulated by an aromatic soluble resin treated with a small quantity of an arylalkyl material. The use of metal soaps as charge control and stabilizing additives to liquid toners is disclosed in many earlier patents (e.g. U.S. Pat. No. 3,900,412; U.S. Pat. No. 3,417,019; U.S. Pat. No. 3,779,924; U.S. Pat. No. 3,788,995). On the other hand, concern is expressed and cures offered for the inefficient action experienced when charge control or other charged additives migrate from the toner particles into the carrier liquid (U.S. Pat. No. 3,900,413; U.S. Pat. No. 3,954,640; U.S. Pat. No. 3,977,983; U.S. Pat. No. 4,081,391; U.S. Pat. No. 4,264,699). In U.S. Pat. No. 3,890,240 it is disclosed that typical liquid toners known in the art have conductivities in the range $1\times10^{-11}$ to $10\times10^{-11}$ mho/cm. A British patent (GB 2,023,860) discloses centrifuging the toner particles out of a liquid toner and redispersing them in fresh liquid as a way of reducing conductivity in the liquid itself. After repeating the process several times the conductivity of the liquid toner was reduced by a factor of about 23 and is disclosed as a sensitive developer for low contrast charge images. In several patents the idea is advanced that the level of free charge within the liquid toner as a function of the mass of toner particles is important to the efficiency of the developing process. In U.S. Pat. No. 4,547,449 this measure was used to evaluate the unwanted charge buildup on replenishment of the toner during use, and in U.S. Pat. No. 4,606,989 it was used as a measure of deterioration of the toner on aging. In U.S. Pat. No. 4,525,446 the aging of the toner was measured by the charge present which was generally related to the zeta potential of the individual particles. A related patent, U.S. Pat. No. 4,564,574, discloses chelating charge director salts onto the polymer and discloses measured values of zeta potential on toner particles. Values of 33 mV and 26.2 mV with particle diameters of 250 nm and 400 nm are given. The import of this patent is improved stability of the liquid toner. A literature reference by Muller et al in 1980 (Research into the Electrokinetic Properties of Electrographic Liquid Developers, V. M. Muller et al, IEEE Transactions on Industry Applications, vol IA-16, pages 771–776 (1980)) treats the liquid toner system theoretically but also gives experimental results on certain toners. Using very small toner particles (all less than about 0.1 micron) they present zeta potentials in the range 15 mV to 99 mV with related conductivity ratios. These latter ratios appear, however, to relate the conductivity of the toner immediately after the current is initiated to the value after prolonged passage of the current. The former is believed to contain both toner particle and soluble ionic species conductivities; the latter is believed to be the basic conductivity of the carrier liquid after most of the added charged carriers have been deposited by the current flow. Finally in U.S. Pat. No. 4,155,862 the charge per unit mass of the toner was related to difficulties experienced in the art in superposing several layers of different colored toners. This latter problem was approached in a different way in U.S. Pat. No. 4,275,136 where adhesion of one toner layer to another was enhanced by aluminum or zinc hydroxide additives on the surface of the toner particles.

Diameters of toner particles in liquid toners vary from a range of 2.5 to 25.0 microns in U.S. Pat. No. 3,900,412 to values in the sub-micron range in U.S. Pat. Nos. 4,032,463, 4,081,391, and 4,525,446, and are even smaller in the Muller paper (supra). It is stated in U.S. Pat. No. 4,032,463 that the prior art makes it clear that sizes in the range 0.1 to 0.3 microns are not preferred because they give low image densities.

Liquid toners which provide developed images which rapidly self-fix to a smooth surface at room temperature after removal of the carrier liquid are disclosed in U.S. Pat. No. 4,480,022 and U.S. Pat. No. 4,507,377. These toner images are said to have higher adhesion to the substrate and to be less liable to crack. No disclosure is made of their use in multicolor image assemblies.

Explicit references to liquid developer compositions designed for use with half-tone images are not common in the art. Thus U.S. Pat. Nos. 3,594,161, 4,182,266, 4,358,195, 4,510,223, 4,547,061, and 4,556,309 all disclose electrophotographic systems designed for half-tone images without giving details of the composition of the toners used. In U.S. Pat. No. 4,640,605, no details of toner constitution are given, but development conditions like bias field are specified without relating them to the toner parameters. In U.S. Pat. No. 4,657,831, again no toner details are given, but optical modification of developed multicolor half-tone dots is disclosed to simulate in a proof the dot gain found on printing. EPA 85301933.9 describes the influence on tone reproduction in half-tone images of the statistical distribution of charges on the toner particles but gives no details of other constitutional parameters. Only U.S. Pat. No. 4,600,669 provides details of liquid toners for use in half-tone image proofing; these toners contain toner particles comprising colorant, polyester binder, a wax and a wax dispersant, the particles being suspended in an insulating carrier liquid.

The art therefore discloses a consciousness of the importance of the physical parameters of the liquid toner—conductivities, zeta potentials of toner particles, charge per particle or per unit mass of particles, and the localization of the charge on the particles. Most of the references above are concerned with the efficiency of liquid toners in the context of monochromatic image development. Of those giving any appreciable details of the toners used, only U.S. Pat. Nos. 4,155,862, 4,275,136, and 4,600,669 are explicitly concerned with multicolor toned images, and only the first of these relates the quality of the multicolor toned assembly to parameters such as the charge per gram of the toner particles.

Other features of electrophotographic imaging are known and are taught in references such as U.S. Pat. No. 3,248,216 describes halftoning an image to reduce the electrophotographic contrast.

U.S. Pat. No. 3,362,907 describes a liquid developer with sharp cut off response that uses a sensitizing agent to adjust contrast.

U.S. Pat. No. 3,560,203 and U.S. Pat. No. 3,784,397 discuss development and edge enhancement.

U.S. Pat. No. 3,635,195 describes producing halftone prints with a developer that contains an array of projections. High fields are used (close spacing).

U.S. Pat. No. 3,707,139 discusses the flow of toners through a gap and the spacing to affect development.

U.S. Pat. No. 3,766,072 describes a method to reduce edge effect with a two pigment developer that varies in conductivity.

U.S. Pat. No. 3,799,791 describes a field controlled development where the photoreceptor is held away from the developer by the liquid (thus narrow gap)

U.S. Pat. No. 3,817,748 describes contrast control with polar liquid imaging.

U.S. Pat. No. 4,023,900 describes adjusting the contrast by process conditions. However this is specifically applied to patterned application of polar liquids.

U.S. Pat. No. 4,623,241 discusses some interactive effects to optimize development density.

U.S. Pat. No. 4,648,704 describes development conditions where lower concentration toners are described as capable of developing small image detail with greater density and sharper edges. Research disclosure 167823 discusses dry toner conductivity to adjust edge enhancement and copy contrast.

SUMMARY OF THE INVENTION

A unique liquid toner dispersion is described which gives very high contrast halftone dot reproduction when imaged with low contrast light sources such as gaussian laser light beams. Process conditions are described in which the characteristics of these toners are advantageously used to generate the sharp dots. The invention makes use of certain charging mechanisms of the toner particles to give very rapid deposition. The rate of deposition is concentration-dependent but the same maximum density may be obtained at each concentration if sufficient development time is given. These charging mechanisms give highly mobile particles with high zeta potential, minimized charge level associated with the particle, and virtually no residual charge in the liquid milieu. Even when deposited to high optical densities, such toners retain a high charge discrimination between exposed and unexposed areas of the photoconductor and thus enhances dot sharpness. Development to completely compensate the charge on the photoreceptor as is found with many other liquid toners is not required with toners of this invention. This facilitates high but well controlled deposition rates. Particles with less charge may be used because the toner is formulated such that the steric stabilizers used contribute to the mobility and stability which otherwise would require high charge particles. The imaging process uses high electric fields in combination with low toner particle concentration and rapid replenishment of the liquid to enhance the dot sharpness while maintaining large area density uniformity.

This invention has particular utility in imaging systems where sharp, high contrast dots are required. It has use, in particular, in high resolution electronic writing systems where the imaging light is less sharp than that obtained using lithographic film and contact exposure. It is especially useful in electrophotographic generation of full color halftone images which would function as digital proofs.

Commercial liquid toners are usually loosely charged with the charge director in equilibrium with both the particle and the liquid milieu. Images with these toners show low contrast. The individual toned dots tend to be smeared out and fill-in between dots is common. The toners would be useful for continuous tone imaging or where sharp high resolution imaging is not required. Some patents describe toners which have higher contrast but this is usually at the expense of grainier images, toner stability and particle size and the rate of development tends to be lower. The toners in this invention advance the art in that they give rapid and sharp development in part due to the specific attachment of the charge to the particle. In addition, the attachment of certain steric stabilizing chains to the core particle to provide dispersion stability is found to increase toner deposition rates for high contrast imaging.

The generation of sharp dots from continuous tone images is conventionally done using special silver halide formulations and development processes like infectious development. These silver halide materials are also used in laser writing output recorders where the writing beam is focused to a very narrow beam, usually of diameter less than 10 microns. It has been found that high contrast dots can be generated using larger diameter and less focused laser beams. It is here described that electrophotographic materials that give conventionally measured low contrast typically less than 4, can be processed to give sharp halftone dots when used with toners as described in the present invention. It was not obvious that sharp dots with the required optical density could be made with laser beams with beam diameter about the same as the diameter of the dot, for example 30 microns.

BRIEF DESCRIPTION OF THE DRAWINGS

The FIGURE shows a schematic representation of the process of the present invention.

DETAILED DESCRIPTION OF THE DRAWING

The schematic diagram of the process of the present invention shown in the FIGURE further describes the broad process and a preferred embodiment of the present invention. A photoconductive surface is charged, and a laser is then used to imagewise expose the charged surface to form an imagewise distribution of charge. A liquid toner (of physical characteristics herein defined) is then applied to the surface. The liquid toner is deposited on the surface in an imagewise fashion. The preferred toners form a film on the surface at temperature of 0° C. to 40° C.

Liquid toners suitable for the practice of this invention are encompassed by the disclosure in U.S. patent application Ser. No. 07/279,424, filed Dec. 2, 1988, which is incorporated herein by reference for its disclosure of toners.

The liquid toners according to that invention comprise a carrier liquid having a resistivity of at least $10^{13}$ ohm-cm and a dielectric constant less than 3.5, and dispersed in the carrier liquid, colored or black toner particles containing at least one resin or polymer conferring amphiphatic properties with respect to the carrier liquid, and optionally at least one moiety acting as a charge directing agent.

This present disclosure shows that liquid toners for development of half-tone images of the highest quality may be uniquely characterized by two parameters:

(a) more than 70% of the conductivity is contributed by the charged toner particles as opposed to the background conductivity contributed by ionic species in solution in the carrier liquid, at a toner solids concentration in the range 0.1 to 1.0 weight %, preferably in the range 0.1 to 0.5 weight % and most preferably in the range 0.2 to 0.4 weight %, (b) the zeta potential of the particles is within a range from 60 mV to 200 mV. For the reverse development used in this invention, the sign of the zeta potential should be the same as the sign of the charge on the photoconductor. For multicolor toner overlay images this invention teaches that the sign should be positive, but for monochrome images the sign may optionally be negative. We have made monochrome images with black toner which gave toned density of about 4 together with high quality half-tone dots. Printing plates obtained from these half-tone separations were found to be of high quality.

This disclosure further shows that for multicolor images, the efficiency of overlay of such liquid toner developers is enhanced by the satisfaction of a third parameter requirement, namely (c) toner particle compositions such that where deposited during development of the electrostatic latent image, they film-form at ambient temperature immediately after removal of the carrier liquid. To this end the resins or polymers used in the toner particles should have $T_g$ values below 25° C. and preferably below −10° C.

With monochrome images where there is no overlay requirement, the parameter (c) is optional. Indeed, for lithographic separation half-tone images, film-forming of the deposited toner may be a disadvantage in that higher densities can be achieved by the added effect of scattering in the toner image (high Callier coefficient).

Two related prior art patents (U.S. Pat. No. 4,480,022 and 4,507,377) may be related to parameter (c) in that they disclose and claim $T_g$ in the range 30° C. and −10° C. as a means to self-fix the deposited toner to a smooth surface without requiring a subsequent heating treatment; two other related patents U.S. Pat. Nos. 4,032,463 and 4,081,391 and the Muller et al, paper disclose information relative to parameter (b) in that they define zeta potentials and disclose values, but whereas these patents use it only to determine the sign of the charge on the toner particles, the Muller paper has a wider interest particularly in the control of particle size and dispersion stability. A number of patents and the Muller paper discuss the need to reduce the size of the charged species in solution in the carrier liquid without identifying the parameter (a) itself; two other patents, U.S. Pat. No. 4,660,503 and U.S. Pat. No. 4,701,387, disclose physical methods of removing unwanted ions deposited on the image during development. None of these references presents the parameters as requirements for faithful multicolor image reproduction when assembling two or more colored toners one on top of another on the photoconductor. One patent is conscious of the requirement of designing the electrical properties of the liquid toner to obtain good overlay properties, but uses simple conductivity values and charge per unit mass of toner as the arbiters. We have shown that these parameters are not definative of the required overlay properties. No combination of the references teaches the importance of the two or three parameters we have found necessary for good overlay properties and the levels and ranges specified here have not been disclosed in the art. Nowhere is it disclosed that all the toners in an overlay set must satisfy these parameters.

It would be helpful in understanding the practice of the present invention to be clear on the meaning of certain terms used in the description of the invention. "Conductivity" as used herein is volume conductivity and may be measured by standard electrical bridge techniques (e.g., C. F. Prutton and S. H. Maron, *Fundamental Principles of Physical Chemistry*, Revised Edition, 1951, The MacMillan Company, N.Y., pp. 448–455). The volume conductivity is given by the measured current divided by the area of the plate electrode and by the field E. The volume conductivity has units of mhos/cm.

Specific Solids Conductivity, $C_s$, is often referred to as equivalent solids conductivity. This is the ratio of the volume conductivity to the weight percent ($W_p$) of total solids in the liquid developer. $W_p$ may be obtained directly by evaporating the liquid carrier from a measured weight of liquid toner and weighing the solids residue.

The ratio of conductivities is defined as $C_b/C_i$ where $C_b$ is defined as the conductivity of the carrier liquid as it appears in the toner and $C_i$ is defined as the conductivity of the liquid toner as a whole.

Measurement of $C_b$ and $C_i$ should be taken within a time equal to or less than about 5% of the time constant for the measurement conditions chosen (as disclosed herein). The ratio of conductivities is a measure of the importance of the spurious conductivity associated with the charged toner particles and therefore not contributing to the deposition of toner.

The performance properties of toners will now be related to the physical and chemical properties of the liquid toners which are disclosed as satisfying these requirements.

a) Conductivity of a liquid toner has been well established in the art as a measure of the effectiveness of a toner in developing electrophotographic images. A range of values from $1.0\times10^{-11}$ mho/cm to $10.0\times10^{-11}$ mho/cm has been disclosed as advantageous in U.S. Pat. No. 3,890,240. High conductivities generally indicated inefficient deposition of the charges on the toner particles and were seen in the low relationship between current density and toner deposited during development. Low conductivities indicated little or no charging of the toner particles and led to very low development rates. The use of charge director compounds to ensure sufficient charge associated with each particle is a common practice. There has in recent times been a realization that even with the use of charge directors there can be much unwanted charge situated on charged species in solution in the carrier liquid. Such unwanted charge produces inefficiency, instability and inconsistency in the development. Suitable efforts to localize the charges onto the toner particles and to ensure that there is substantially no migration of charge from those particles into the liquid, give substantial improvements. As a measure of the required properties, the present description uses the ratio between the conductivity of the carrier liquid as it appears in the liquid toner and the conductivity of the liquid toner as a whole. This ratio should be less than 0.3.

Prior art toners that have been examined have shown ratios much larger than this, in the region of 0.95.

b) The charge carried by each of the toner particles is known in the art to be important in stabilising the dispersion of the particles in the carrier liquid especially upon long term storage. It has also been found that it is also a prime factor in ensuring the adhesion of the freshly deposited toner particles to the receiving surface whether this is the photoconductor or a previously deposited toner layer. It is believed that the adhesion is connected with the velocity with which the particle impinges on the imaging surface under the influence of the electric bias field produced by the development electrode in the reverse development procedure. The effectiveness of the charge in increasing mobility (and therefore the velocity under the influence of the electric bias field) of the toner particles in the environment of the carrier liquid is measured by the zeta potential of the particle. By definition the zeta potential is the potential gradient across the difuse double layer, which is the region between the rigid layer attached to the toner particle and the bulk of the solution (ref. Physical Chemistry of Surfaces, by Arthur Adamson, 4th.Edition, pages 198-200). The zeta potential was evaluated here from a measurement of toner particle mobility using a parallel plate capacitor arrangement. The capacitor plate area was large compared with the distance between the plates so as to obtain a uniform electric field $E=V/d$ where V was the applied voltage and d the plate separation. The liquid toner filled the space between the plates and the current resulting from the voltage V was monitored with a Keithley 6/6 Digital Electrometer as a function of time. Typically the current was found to show an exponential decay due to the sweeping out of charged ions and charged toner particles. The legitimate assumption was made that the time constant for the toner particles was much longer than that for the ionic species and therefore the two values could be separated in the decay curves. If t is the time constant then the velocity (u) of the charged toner particles under the influence of the field E is $u=d/t$ and the toner mobility (m) is $m=u/E$.

The zeta potential (z) is then given by $z=3sm/(2ee_o)$ where s is the viscosity of the liquid, $e_o$ is the electric permitivity, and e is the dielectric constant of the carrier liquid. References in the literature to zeta potential of toner particles (U.S. Pat. No. 4,564,574 and Muller et al above) are limited to the stabilising effect of the zeta potential on the dispersion of the toner particles in the liquid. We found that the values given in the patent, 26 mV to 33 mV, are too small for the purposes of the present invention.

Although the zeta values in Muller et al are higher, and within the range of those recited in the practice of the present inventions, they are combined with conductivity values much lower than are required. It has also been found that the zeta potential should be relatively uniform in a given toner and be centered within the range of +60 mV to +200 mV.

The process by which the multicolored half-tone images were produced is described in detail in U.S. Pat. No. 4,728,983 which is included herein by reference.

In one embodiment these toners were imaged in succession onto an organic receptor layer comprising BBCPM {bis-5,5'-(N-ethylbenzo(a)carbazolyl)-phenylmethane} sensitized with an indolenine dye having a peak absorption in solution at a wavelength of 820 nm, charged to +520 volts and discharged with a laser scanner emitting light of wavelength 833 nm to a potential of +60 volts at 1500 scan lines per inch. Reverse development mode was used with a gap of 15/1000 inch between the electrode and the photoconductor, the bias potential of the electrode being +350 volts. Dwell time between the development electrodes was 1.5 seconds. The assembled developed images were transferred to a coated paper receptor sheet.

We have found that the conductivity is a function of the solids concentration of the liquid toner. We have further found that a parameter obtained by dividing the conductivity by the solids concentration in weight % is a better indicator of the acceptability of the liquid toner than the conductivity alone. We shall call this parameter the equivalent solids conductivity, $C_s$. Sharp, high-contrast half-tone dots result from the use of liquid toners with low solids concentration and with a low conductivity ratio as presented in parameter (a) above. This is especially true when the ratio of mobility to equivalent solids conductivity is high. The initial equivalent solids conductivity should be less than $10^{-10}$ mho/cm.

The development conditions must be matched to these liquid toner properties so as to ensure high deposition rates without depletion of toner concentration in the development gap. This is especially true when the ratio of mobility to equivalent solids conductivity is high.

Thus a gap in the range 250 microns to 500 microns with a bias voltage to give a field in the range 5000 V/cm to 25,000 V/cm were found to be particularly suitable with the toner parameters given in (a) above.

Dwell times in the range 1 second to 3 seconds were found effective with a high flow of liquid toner through the gap.

EXAMPLES

Definitions:

T.O.D—transmission optical density

R.O.D—reflection optical density

BBCPM—bis-5,5'-(N-ethylbenzo(a)carbazolyl)-phenylmethane

HQ—hydroxyquinoline chelate

CHBM—carboxyhydroxybenzylmethacrylate-salicylate chelate

Toner Preparation

Preparation of cyan toner #1 was as follows. A cyan mill base was prepared by dispersing cyan pigment (Sun Chemical No. 249-1282) with Alkanol DOA (amine containing oil soluble polymer) by silverson mixing for 3 hours. Samples from the base were mixed with oil soluble acid aluminum diisopropyl salicylate. The resulting dispersions when tested in a conductivity cell gave cyan dye deposition on the negative electrode indicating positively charged toner particles. This dispersion was stable even after keeping for one month.

Cyan toner #1 was diluted to 0.2% solids in Isopar G. It was measured to have the following properties:

Initial conductivity: $1.25\times10E-12$ (mho/cm)
Electrical mobility: $1.85\times10E-5$ (cm-cm/vt-sec)
Deposition rate: 0.75 sec/50% deposition
Charge/density: 0.02 microcoul/T.O.D.-$cm^2$
Residual Conductivity: 25% of initial conductivity This toner was imaged using BBCPM organic photoreceptor charged to 600 volts and exposed using a HeNe laser scanner to a residual voltage of 75 volts. The laser spot was 30 microns in diameter and was addressed at 1500 dots per inch. The dot pattern used for exposure was a step target each step of which was 1 cm square with halftone dots selected from the range 5% to 98% at 150 line/inch halftone screen. The development process included a 2 second dwell time in a developer gap ½ inch (1.27 cm) wide and spaced 15/1000 inch (0.378 mm) from the photoreceptor surface. The toner was rapidly pumped through this gap and removed by vacuum. A +350 volt bias was applied to the electrode to give a developer field of 7,200 volts/cm. After development the image was thermally transferred and embedded into a coated base paper to fix the image as described in copending U.S. patent application Ser. No. 06/708,983 filed Mar. 7,1985, now abandoned, which is included herein by reference.

Optical micrographs of the dots showed very sharp dots and holes reproduced through the tonal range. At these conditions a single exposed spot was measured to be 12 microns in diameter. Microdensitometry showed these dots were very sharp with density as high as solid areas. Other images were made with varying toner concentrations and bias voltages. Single dots from 4 to 20 microns in diameter were obtained using this process. It was noted that solid areas filled in well, with Dmax from 1.4–2.2 being obtained. Some edge enhancement was noted with the edges measured from 20–50% higher in density than the solid area and was found to be a function of the flow rates and replenishment in the development zone.

These dots were evaluated using a Zeiss image processing camera. Edge sharpness of the dots was measured and compared with halftone dots generated using Matchprint TM materials. The toner edge contrast was found to be equal to the lithographic contact film exposed Matchprint TM dots.

James River Graphics C57 black toner is found to give quite high contrast dots, due in part to a more highly concentrated toner and large particle size. It is not as sharp as cyan toner #1, has a slightly lower deposition rate, and has a shorter shelflife.

EXAMPLE 2

A black toner of the following composition was used in place of the cyan toner #1 in Example 1.

Dispersant—poybutenyl succinimide amine: 9 wt. %
ISOPAR TM M: 73 wt. %
Microlith TM CP pigment: 18 wt. %

This concentrate was diluted to 0.6 wt. % with ISOPAR TM M to give a working developer which had the following properties.

Equivalent solids conductivity $(C_s)=5.09\times10^{-11}$ mho/cm. wt %
Electrical mobility $=-1.45\times10^{-5}cm^2/V.sec$
Zeta potential $=-124$ mV and a particle size range 0.4 to 1.2 microns.

This toner when used in similar tests to those in Example 1, gave half-tone results similar to those with cyan toner #1. This toner gives high density in deposited areas, in excess of 4, which appears to be related to large particle size and high particle mobility giving thick deposition of toner in the process development time. The high density is obtained without sacrifice of half-tone dot quality.

EXAMPLE 3

Use of novel organosol liquid toners of the invention.

Three organosol toners using a chelation charging mechanism and organic pigments were imaged as above. These toners were made by the procedures described in Preparations given below in Example 4. These toners had the following average characteristics:

Diluted Concentration: 0.2–0.4 wt. %
Initial Conductivity: $0.4–1.5\times10E-11$ (mho/cm)
Electrical Mobility: $0.7–2.2\times10E-5$ ($cm^2$/v.sec)
Charge/Optical Density: 0.02–0.08 microC/-T.O.D.$-cm^2$
Large area Contrast: 0.9–4.0

Images made with these toners showed very sharp dot reproduction. Photomicroscopy showed sharp edges for the small 5% dots thru the 98% dot tonal curve. Solid density was above 1.4 R.0.D. in all cases. It was especially noted that when these same toners were imaged using a continuous tone target they showed quite low contrast. In the laser imaging process, where a low contrast light beam is used, it has been found that these toners produce very sharp toner deposits. Toners with high particle mobility, but low total charge carried by the toner per unit of optical density of the image in combination with low percentages of background charge are required to accomplish this. FIG. 1 shows the rate of deposition of several toners. Toners such as those represented by curves A and B, give the required dot sharpness when a ratio of not more than 0.75 exists between the charge deposited by the toner to give the required optical density for a particular exposure and the surface charge capacity of the photoreceptor for the same exposure and defined by the development bias voltage. Additionally, high field development conditions of over 5 kV/cm are required for uniform dot and solid reproduction when using low equivalent solids conductivity toners.

Toners with lower deposition rates and higher charge per mass tended to give softer dots, and higher percent dots would fill in. Also toners where additional charging agent was put into the formulation to improve stability showed lower contrast. Toners with low charge per particle but with higher residual conductivity showed poorer stability and shelflife. Commercial toners with higher contrast also had larger particle size and poorer transparency.

It is found that toners where the charge is specifically attached to the pigment/binder particles are required to accomplish sharp dot reproduction using low contrast laser light. Additionally it is observed that for this type of high contrast dot reproduction by electronic imaging, organosol toners where the polymeric system consists of steric stabilizer, charge director and a core binder all attached to the colorant particle are required.

EXAMPLE 4

Properties of Liquid Toners of the Invention.

These examples relate to liquid toners made by the procedures given in the later examples. These toners were based on small organosol particles surrounding a pigment particle and having attached chelating moieties to which metal soap charge generators were chelated. The inner core of the organosol particles was insoluble in the carrier liquid whereas the outer linking groups were compatible with said liquid thus giving a stable dispersion. The metal soap charge generators were firmly attached to the organosol by chelating action so that their migration into the body of the liquid was precluded.

A four-color set of toners were made based on the preparations of Example 5 below using hydroxyquinoline chelate (HQ) for attaching the charge generator, and having an ethylacrylate core of $T_g = -12.5°$ C. Measured properties were:

| SAMPLE | $C_i \times 10^{11}$ | $C_b \times 10^{11}$ | RATIO | $M \times 10^5$ | ZETA mV |
|---|---|---|---|---|---|
| TONER #2 BLACK 0.6 wt. % | 0.95 | 0.33 | 0.35 | 1.01 | 86.3 |
| TONER #3 MAGENTA 0.3 wt. % | 0.53 | 0.22 | 0.42 | 0.71 | 60.7 |
| TONER #4 CYAN 0.3 wt. % | 0.57 | 0.14 | 0.25 | 1.34 | 114.3 |
| TONER #5 YELLOW 0.3 wt. % | 0.75 | 0.19 | 0.25 | 1.37 | 117.0 |

A similar toner prepared with carboxyhyroxybenzylmethacrylate-salicylate chelate (CHBM) for attaching the charge generator had the following properties: EA core still gave $T_g$ TM $-12.5°$ C. and

| | | | | | |
|---|---|---|---|---|---|
| TONER #6 YELLOW 0.3 wt. % | 0.76 | 0.43 | 0.57 | 1.21 | 103.4 |

Yet another similar toner made with CHBM and with a poly-methylacrylate core of $T_g = 13°$ C. had properties:

| | | | | | |
|---|---|---|---|---|---|
| TONER #7 MAGENTA 0.3 wt. % | 0.52 | 0.28 | 0.54 | 1.11 | 94.9 |

Any selection of these liquid toners used to produce multitoned images was found to give very good overlay properties.

EXAMPLE 5

Preparation of Liquid Toners of the Invention

Preparation of organosol consists of four steps:

a) Preparation of stabilizer precurser, b) Addition reaction of coupling reagent (e.g., hydroxyethylmethacrylate), c) latex formation by polymerization of the stabilizer (a & b above) with core monomer, d) addition of metal soap for chelation and toner charge generation.

This is illustrated in the preparation of a lauryl methacrylate/salicylate (CHBM) stabilizer; ethyl acrylate core latex.

Preparation of a stabilizer containing salicylic acid groups i) Preparation of a stabilizer precurser:

In a 500 ml 2-necked flask fitted with a thermometer, and a reflux condenser connected to a $N_2$ source, was introduced a mixture of 95 g of lauryl methacrylate, 2 g of 2-vinyl-4,4-dimethylazlactone (VDM), 3 g of CHBM, 1 g of azobis-isobutyronitrile (AIBN), 100 g of toluene and 100 g of ethylacetate. The flask was purged with $N_2$ and heated at 70° C. for 8 hours. A clear polymeric solution was obtained. An IR spectra of a dry film of the polymeric solution showed an azlactone carbonyl at 5.4 microns.

ii) Reaction of (A) above with 2-hydroxyethylmethacrylate (HEMA):

A mixture of 2 g of HEMA, 1.5 g of 10% p-dodecylbenzene sufonate (DBS) in heptane and 15 ml of ethyl acetate was added to the polymer solution of A above. The reaction mixture was stirred at room temperature overnight. The IR spectra of a dry film of the polymeric solution showed the disappearance of the azlactone carbonyl peak, indicting the completion of the reaction of the azlactone with HEMA. Ethyacetate and toluene were removed from the stabilizer by adding an equal volume of Isopar TM G and distilling the ethylacetate and the toluene under reduced pressure. The polymeric solution looked turbid. The polymer solution was filtered through Whatman filter paper #2 to collect the unreacted salicylic acid. There was no remaining solids on the filter paper, indicating that all the CHBM has been incorporated. The turbidity may have been due to the insolubiltiy of the pendant salicylic groups.

iii) Preparation of Latices—General Procedure:

In a 2 L—2 necked flask fitted with a thermometer and a reflux condenser connected to a nitrogen gas source, was introduced a mixtured a 1200 ml of Isopar G, a solution of a stabilizer of the above examples containing 35 g of solid polymer, 1.5 g of AIBN and 70 g of the core monomer*. The flask was purged with $N_2$ and heated at 70° C. while stirring. The reaction temperature was maintained at 70° C. for 12 hours. A portion cf Isopar TM G was distilled under reduced pressure.

*Core monomer was ethylacrylate, (and could be methlacrylate, vinylacetate and other suitable monomers.)

vi) Preparation of metal chelate latices

Metal soap solution—20% zirconium neodecanoate in Isopar TM G. To a hot solution of the metal soap in Isopar TM G was added portionwise a latex containing 1(wt) % of a coordinating compound equimolar with the metal soap present in the hot Isopar TM solution. The mixture was heated for 5 hours at the indicated temperature in the table below.

Resultant latex had a core Tg of $-12.5°$ C. and an overall particle size of 197 +/−47 nm.

v) Pigments

Pigment purity or choice of pigment is important. Commercial pigments (Sun Chemical) were purified prior to dispersing with the chelate organosols. For example Sun Chem. Cyan 249-1282 was soxhlet extracted with EtOH or EtOH/Toluene 80/20 mix until the extracted liquid was clear (24–72 hrs). Then the solvent wet pigment was stirred with Isopar TM G to give 10–20% solids. While the slurry was stirring the temperature was kept at 75°–95° C. and nitrogen gas was bubbled through for 4–6 hours to drive off any excess extraction solvents. The resultant pigment/Isopar G slurry was used for toner preparation.

vi) Toner formulation

A weight ratio of 2:1 to 10:1 organosol to pigment was blended together and then mechanically dispersed, usually by sand milling or silverson mixer. The dispersion was kept at a temperature of between 40° C. and 30° C. and normally took 4–6 hours to disperse. The resultant toner (e.g. Cyan) had the following properties.

| Particle Size | Cond (0.3% wt) | Cond Ratio | Zeta Pot |
|---|---|---|---|
| 220 ± 40 nm | $0.9 \times 10^{-11}$ mho/cm | 0.57 | 76.8 mV |

The resultant milled base had a wt % in the range 8–10.0%. Toners were prepared by dilution with Isopar TM G to 0.3% wt.

We claim:

1. A process for development of electrophotographic images exposed by laser scan techniques by applying liquid toner, comprising
   a) charge sensitizing a photoconductive layer surface to give a first electric field above said surface,
   b) exposing a half-tone image onto said surface by laser scan thereby forming an imagewise distribution of electrostatic charges,
   c) applying said toner between a developer electrode and a said surface at a rate in excess of that required by said development in the presence of a second electric field of at least 5000 volts/cm, said second field being normal to the surface and opposed to said first field, said toner comprising toner particles dispersed in a non-polar insulating liquid, whereby said toner particles are deposited imagewise on said surface, said toner being characterized as having the following properties
      i) an initial equivalent solids conductivity of less than $10^{-10}$ mho/cm,
      ii) a ratio of background conductivity to initial conductivity of less than 0.3,
      iii) the toner particles having a zeta potential in the range of 60 mV to 200 mV, and
      iv) a concentration of said toner particles in the liquid toner being in the range 0.1 to 1.0 weight %.

2. A process as recited in claim 1 wherein said toner is further characterized as having the property that
   v) said toner particles film-form on said surface when deposited at ambient temperatures in the range 0° C. to 40° C.

3. A process as recited in claim 1 wherein said toner particles have a $T_g$ value less than 25° C.

4. A process as recited in claim 3 wherein the $T_g$ value is below −10° C.

5. A process as recited in claim 3 wherein said second electric field is in the range 5000 volts/cm to 25,000 volts/cm.

6. A process as recited in claim 1 wherein said ratio of background conductivity to initial conductivity is less than 0.2.

7. An electrophotographic process for producing high quality full color half-tone prints wherein color separation toner images are assembled on a positively charged to produce a first field photoreceptor surface using successive liquid toning steps, comprising
   a) selecting two or more liquid toners comprising toner particles dispersed in a non-polar carrier liquid,
   b) applying each said liquid toner to said surface at a rate in excess of that required by said development in the presence of a second electric field of at least 5000 volts/cm, said field being normal to the surface and opposed to said first field, whereby said toner particles are deposited imagewise on said surface, all of said liquid toners characterized as having
      i) an initial specific solids conductivity of less than $10^{-10}$mho/cm,
      ii) a ratio of background conductivity to initial conductivity of less than 0.3,
      iii) the toner particles having a zeta potential in the range +60 mV to +200 mV, and
   iv) a concentration of said toner particles in the liquid toner being in the range 0.1 to 1.0 weight %.

8. A process as recited in claim 7 wherein said toner is further characterized as having the property that
   v) said toner particles film-form on said surface when deposited at ambient temperatures in the range 0° C. to 40° C.

9. A process as recited in claim 7 wherein said toner is further characterized as having a $T_g$ value below 25° C.

10. A process as recited in claim 9 wherein the value is below −10° C.

11. A process as recited in claim 7 wherein said second electric field establishes an imagewise surface charge capacity for charge conveyed by said toner particles deposited imagewise, and said toner particles deposited imagewise contribute added charge density no more than 0.75 of said imagewise surface charge capacity.

* * * * *

UNITED STATES PATENT AND TRADEMARK OFFICE

CERTIFICATE OF CORRECTION

PATENT NO. : 5,061,583

DATED : October 29, 1991

INVENTOR(S) : Gregory L. Zwadlo; Kevin M. Kidnie; and Mohamed A. Elmasry

It is certified that error appears in the above-identified patent and that said Letters Patent is hereby corrected as shown below:

Column 5, line 1: "temperature" should read --temperatures--;
Column 10, line 18: on the line following "...(mho/cm)" insert --Residual Conductivity: less than 20% of Initial Cond.--
Column 11, line 34: "TgTM-12.5$^{0}$C" should read --Tg= -12.5$^{o}$C--
Column 12, line 19: "indicting" should read --indicating--
Column 12, line 20: "Ethyacetate" should read --Ethylacetate--
Column 12, line 38: "cf" should read --of--;
Column 14, lines 11-12: Delete "positively charged to produce a first field" and insert same after "surface" instead.

Signed and Sealed this

Ninth Day of November, 1993

*Attest:*

*Attesting Officer*

BRUCE LEHMAN

*Commissioner of Patents and Trademarks*